US005549054A

United States Patent [19]

Lewis

[11] Patent Number: 5,549,054

[45] Date of Patent: Aug. 27, 1996

[54] SHELF EXTENDER

[75] Inventor: Kirk Lewis, Lees Summit, Mo.

[73] Assignee: Fast Industries, Inc., Ft. Lauderdale, Fla.

[21] Appl. No.: 540,824

[22] Filed: Oct. 11, 1995

Related U.S. Application Data

[63] Continuation of Ser. No. 180,302, Jan. 12, 1994, abandoned.

[51] Int. Cl.[6] ..... A47B 5/00

[52] U.S. Cl. ..... 108/152; 211/90

[58] Field of Search ..... 108/42, 69, 152, 108/153, 47, 90; 211/90; 248/205.4

[56] References Cited

U.S. PATENT DOCUMENTS

| | | | |
|---|---|---|---|
| 1,138,176 | 5/1915 | Ebner | 108/152 |
| 1,446,231 | 2/1923 | West | 211/90 |
| 1,558,977 | 10/1925 | Gray | 211/90 |
| 2,679,373 | 5/1954 | Henley | 248/205.4 |

*Primary Examiner*—Peter M. Cuomo
*Assistant Examiner*—Gerald A. Anderson
*Attorney, Agent, or Firm*—Jacobson, Price, Holman & Stern, PLLC

[57] ABSTRACT

A shelf extender for use on supermarket and like shelves is made from a sheet of plastic which has an adhesive strip or other attachment along a back edge thereof for securing same to the top surface of the shelf with a front portion of the sheet projecting beyond the front edge of the shelf. The front portion of the sheet has fold-down tabs which engage the front edge of the shelf to form cantilever supports or buttresses for the sheet when it is under load. Fold-up strips along the front and sides of the sheet form a surrounding wall for the shelf extender.

11 Claims, 2 Drawing Sheets

SHELF EXTENDER

This is a continuation of application Ser. No. 08/180,302, filed Jan. 12, 1994 which was abandoned upon the filing hereof.

BACKGROUND OF THE INVENTION

This invention relates to a shelf extender useful, for example, to increase the available display area of a shelf in a supermarket, other store or point of sale, to provide additional shelf space or to highlight products which are on sale.

Currently used shelf extenders are commonly made of cardboard or metal, but cardboard is somewhat difficult to use and metal is somewhat expensive and permanent in nature. Accordingly, this invention seeks to provide an improved shelf extender which is economical to manufacture, simple to ship and install, versatile in its applications and sturdy in use.

SUMMARY OF THE INVENTION

The invention provides a shelf extender for the purposes indicated which is in the form of a die-cut sheet of plastic (preferably PVC 30 mil. thick) having attachment means along one edge for securing same to the front portion of a shelf so that a main body panel of the sheet extends or projects beyond the front edge of the shelf and fold-down tab means on the main body panel to engage against the front edge of the shelf when the main body panel is loaded with merchandise and thereby provide canti-lever supports or buttresses for the main body panel.

The attachment means along the rear edge of the shelf extender may comprise contact adhesive and/or apertures to receive pins or plugs which are inserted therethrough and into corresponding apertures of a shelf. For shelves without apertures, the contact adhesive is used as the attachment means.

The sheet may have a fold-up front and sides which adhere together with adhesive tabs to form a surround.

Other features and advantages of the invention will become apparent from the following description and claims read in conjunction with the attached drawings.

DETAILED DESCRIPTION OF THE INVENTION

Figure 1:
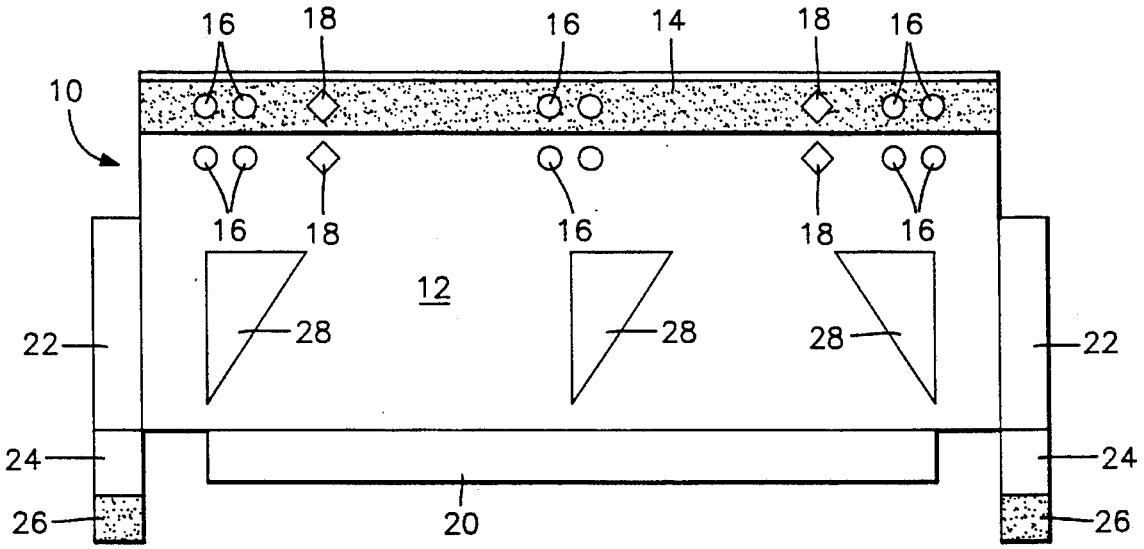
FIG. 1 is a plan view of a plastic blank for a shelf extender according to the invention, FIG. 2 a top perspective view of the blank after a first folding operation to form the shelf extender.

FIG. 1 shows a die-cut blank 10 of plastic sheet, preferably PVC 30 mil. thick. The blank has a rectangular main body panel 12 conveniently about nine inches across and about six inches front to back. Along the back edge of the blank on its lower surface is a strip of contact adhesive 14 (normally covered by release paper). Also along the back edge are groupings of circular and diamond-shaped apertures 16, 18 spaced at distances corresponding to similar apertures which are provided along the front of certain display shelves.

Along its front edge, the blank has a fold-up strip 20 defined by a crease along the front of panel 12, and similar fold-up strips 22 are provided on the side edges, the strips 22 are provided with fold-in tabs 24 having contact adhesive 26 at the ends. The body panel 12 has three triangular shaped fold-down tabs 28 defined by cut-outs in the plastic sheet to provide stabilizing supports or buttresses for the shelf extender as will be described.

Figure 2:
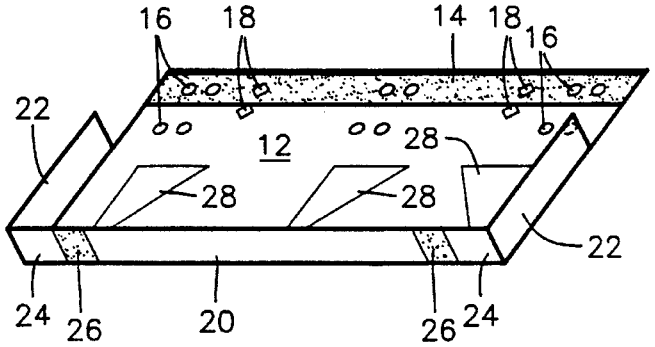
Figure 3:
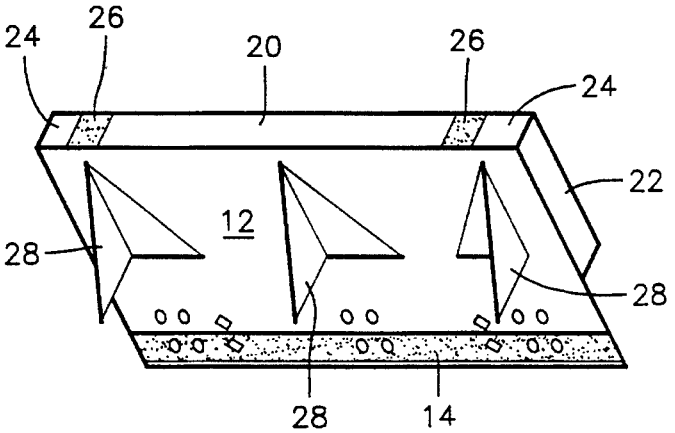
FIG. 3 is a bottom perspective view of the completed shelf extender.

In use, the blank is folded as shown in FIGS. 2 and 3, so that strips 20, 22 are folded up and secured together by the tabs 24, FIG. 2, to form a surround for the shelf extender and then tabs 28 are pressed down, FIG. 3 to complete the construction. The tabs 28 fold down about lines **28*a* which extend in a back to front direction of the blank. Each tab has a back edge 28*b* perpendicular to line 28*a* engaging against a front edge surface of a shelf (see FIGS. 4 and 5**).

Figure 4:
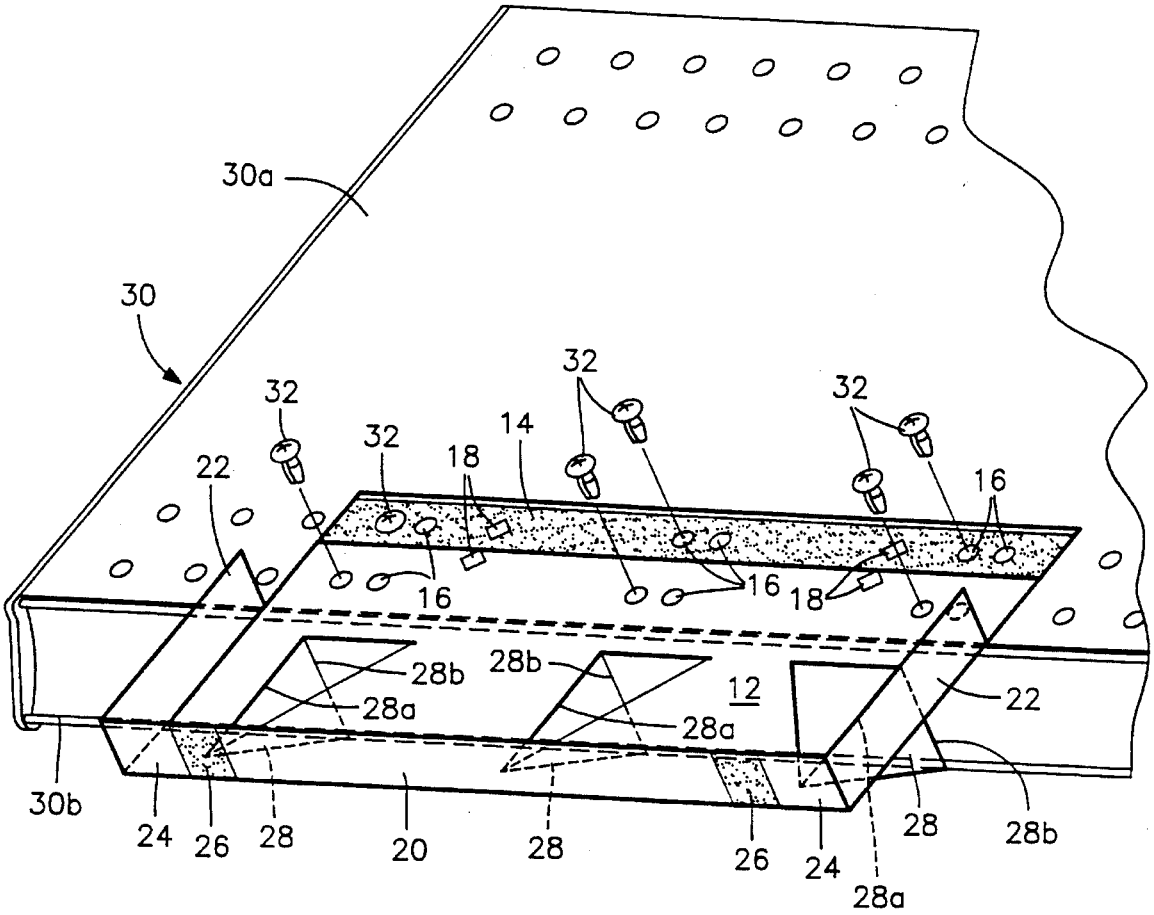
FIG. 4 is an enlarged top perspective view of the shelf extender being attached to a supermarket shelf.
Figure 5:
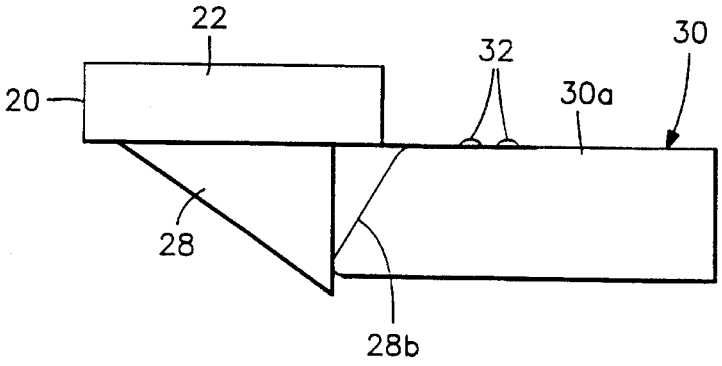
FIG. 5 is a side view of the attached shelf extender and shelf.

A substantially horizontal top surface **30*a*, a downwardly extending front surface 30*b* and a shelf 30 (FIG. 4) which has circular apertures along the front of the top surface, the shelf being of a type which is commonly encountered in supermarkets, etc., the extender is attached thereto solely by plugs or pins 32 frictionally inserted through the apertures 16 and the corresponding shelf apertures. The spacing between the apertures 1*b* and the back edges 28*b* of tabs 28 is such that the tabs will engage against the front surface of the shelf as seen in FIG. 5 when merchandise is placed on the panel 12 to form canti-lever supports or buttresses for the shelf extender. In the embodiment illustrated, the front surface of the shelf is formed as a price channel. Also, as shown in FIGS. 4 and 5, the height of each tab 28 when in use is greater than the height of surface 30*b*** of the shelf.

It will be evident that for shelves having diamond-shaped apertures along the front, also of a commonly encountered type, the extender is attached in similar manner using apertures 18 for the pins or plugs. For shelves with no apertures, the adhesive 14 is used for attaching the extender. Thus, the invention provides a shelf extender well suited to meeting the stated objects.

While only preferred embodiments of the invention have been described herein in detail, the invention is not limited thereby and modifications are possible within the scope of the attached claims.

I claim:

1. In combination with a product display shelf, a shelf extender comprising a die cut plastic sheet having a back edge and a front edge defining a main body panel, attachment means along a back edge portion of the sheet securing said back edge portion to a top substantially horizontal surface of the shelf with a front portion of the body panel projecting beyond a front edge surface of the shelf, said front edge surface extending downwardly from said top surface of the shelf, and tab means projecting downwardly from said front portion of the body panel to engage against the front edge surface of the shelf and provide cantilever supports for the sheet shen said front portion is under load wherein the tab means comprises fold-down tabs defined by cut-outs in the sheet, each tab being folded down about a line extending in a back to front direction of the sheet and each tab having a back edge perpendicular to said line engaging the front edge surface of the shelf.

2. A combination as defined in claim 1 wherein the shelf extender is secured to the shelf solely by said attachment means.

3. A combination as defined in claim 1 wherein said attachment means comprises a strip of contact adhesive along the back edge portion of the sheet.

4. A combination as defined in claim 1 wherein said attachment means comprises apertures in the sheet aligned with corresponding apertures in the shelf and pins received in the corresponding apertures.

5. A combination as defined in claim 1 including upstanding walls along front and side edges of the sheet forming a surround for said front portion of the body panel.

6. A combination as defined in claim 1 wherein said tab means comprises fold-down tabs defined by cut-outs in the sheet.

7. A combination as defined in claim 6 wherein said tabs each have a greater height than said front surface of the shelf.

8. A blank of sheet plastic for forming into a shelf extender, said blank including a back edge portion and front edge portion defining a main body panel therebetween, attachment means along the back edge portion for securing the sheet to an upper surface of a shelf with a front portion of the sheet projecting beyond a front edge surface of the shelf, and triangular-shaped fold-down tabs in said front portion defined by cut-outs in the sheet for engaging against the front edge surface of the shelf and providing cantilever supports for the front edge portion under load each tab being foldable about a line extending in a back to front direction of the sheet and each tab having a back edge for engaging against the front edge surface of the shelf said back edge being perpendicular to said line.

9. A blank as defined in claim 8 including fold-up strips along a front edge and sides of the sheet with adhesive tabs for securing strips to form a surround for the front edge portion of the blank.

10. A blank defined in claim 8 wherein the attachment means includes a strip of contact adhesive along the back edge portion of the sheet.

11. A blank as defined in claim 8 wherein the attachment means includes apertures in the sheet to receive attachment pins.

* * * * *